US011083297B1

(12) United States Patent
Alonzo

(10) Patent No.: US 11,083,297 B1
(45) Date of Patent: Aug. 10, 2021

(54) PORTABLE EASEL

(71) Applicant: Ricardo Alonzo, Kingsburg, CA (US)

(72) Inventor: Ricardo Alonzo, Kingsburg, CA (US)

( * ) Notice: Subject to any disclaimer, the term of this patent is extended or adjusted under 35 U.S.C. 154(b) by 0 days.

(21) Appl. No.: 16/576,066

(22) Filed: Sep. 19, 2019

Related U.S. Application Data

(60) Provisional application No. 62/803,671, filed on Feb. 11, 2019.

(51) Int. Cl.
*A47B 97/04* (2006.01)

(52) U.S. Cl.
CPC ..... *A47B 97/04* (2013.01)

(58) Field of Classification Search
CPC ..... A47B 97/04
USPC ..... 248/441.1
See application file for complete search history.

(56) References Cited

U.S. PATENT DOCUMENTS 6,578,811 B1 * 6/2003 Suzuki ..... G09F 1/14 248/447
7,025,312 B1 * 4/2006 Dare ..... A47J 47/16 211/41.2
7,043,877 B1 * 5/2006 Jensen ..... A01G 9/023 47/82
D628,203 S * 11/2010 Noble ..... D14/447
7,969,732 B1 * 6/2011 Noble ..... F16M 11/041 361/679.56
D654,921 S * 2/2012 Malsan ..... D14/447
D693,353 S * 11/2013 Shu ..... D14/447
D748,616 S * 2/2016 Noble ..... D14/253
9,605,790 B1 * 3/2017 Alonzo ..... F16M 13/00
2015/0144744 A1 * 5/2015 Holtby ..... F16L 1/0246 248/49
2019/0069495 A1 * 3/2019 Kobe ..... A01G 9/28

* cited by examiner

*Primary Examiner* — Muhammad Ijaz
(74) *Attorney, Agent, or Firm* — Kenneth L Tolar

(57) ABSTRACT

A portable easel includes a base component having an upper surface, a lower surface, a continuous periphery and a central aperture. On the upper surface are a plurality of canvas grooves, each having a differing or discrete width and/or depth for receiving an edge of a canvas. The upper surface also includes one or more arcuate notches for retaining artist's tools, such as paint brushes, painting and palette knives, scrapers, etc. Narrow slits are variably positioned on the upper surface to receive and uprightly support canvas boards or similar thinner media. The lower surface of the easel includes a locking means for mating with canvas grooves on another easel to allow multiple easels to be compactly and seamlessly stacked for storage.

10 Claims, 2 Drawing Sheets

PORTABLE EASEL

BACKGROUND OF THE INVENTION

The present invention relates to a compact, portable easel that conveniently supports artist's tools and any number of artist's canvasses at desired angles.

DESCRIPTION OF THE PRIOR ART

A conventional easel uprightly supports a canvas or other artist's work medium in a conveniently accessible orientation to facilitate the creation of paintings. The typical easel generally includes a canvas support frame mounted on support legs that position the canvas in an easily accessible, elevated position. The support frame often includes at least one clamping mechanism for gripping one or more edges of the canvas. In order to transport the easel, a user must collapse and/or disassemble the frame, which is cumbersome and laborious.

In addition, most conventional easels only support a canvas at a predetermined angle, which is not always desirable for certain applications. Because the clamping mechanisms are unreliable, a canvas can be easily dislodged with minimal contact or movement, subjecting the artwork to irreparable damage. Moreover, conventional easel frames are bulky, obtrusive and, therefore, unsuitable for confined spaces.

Accordingly, there is a currently a need for an easel that overcomes the above-described disadvantages associated with the prior art. The present invention addresses this need by providing a low-profile, compact easel formed of a unitary base component having a plurality of deep grooves of varying thicknesses formed on an upper surface. The grooves are dimensioned and configured to receive an edge of any one of numerous artist's media. The compact, low-profile base component will not topple and can be easily transported or stored.

SUMMARY OF THE INVENTION

The present invention relates to a portable easel including a base component having an upper surface, a lower surface, a continuous periphery and a central aperture. On the upper surface are a plurality of canvas grooves, each having a differing or discrete width and/or depth for receiving an edge of a canvas. The upper surface also includes one or more arcuate notches for retaining artist's tools, such as paint brushes, painting and palette knives, scrapers, etc. Narrow slits are variably positioned on the upper surface to receive and uprightly support canvas boards or similar thinner media. The lower surface of the easel could also include a locking means for mating with canvas grooves on another easel to allow multiple easels to be compactly and seamlessly stacked for storage.

It is therefore an object of the present invention to provide an easel that is lightweight, compact and portable.

It is therefore another object of the present invention to provide a portable, compact easel that uprightly supports one or more artist's media at various angles.

It is yet another object of the present invention to provide an easel that requires no assembly, disassembly or other manipulation in order to use or stow.

It is yet even another object of the present invention to provide an easel that can be seamlessly stacked upon other easels for storage.

It is yet even another object of the present invention to provide an easel that can accommodate artist's media of varying thicknesses.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
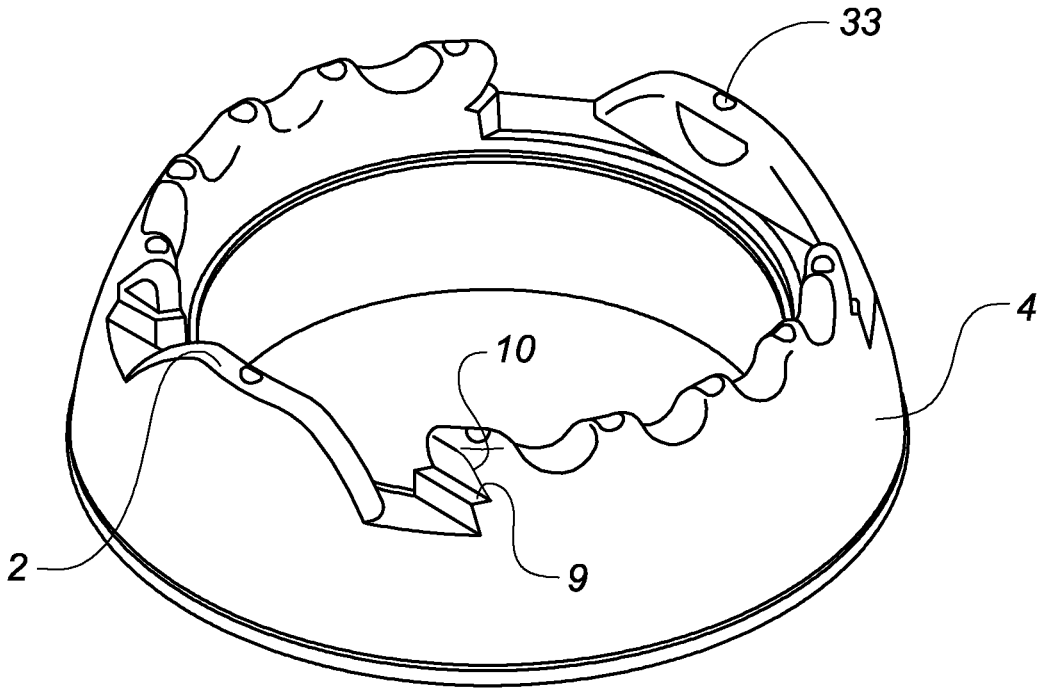
FIG. 1 is an elevated, perspective view of the of the easel according to the present invention.
Figure 2:
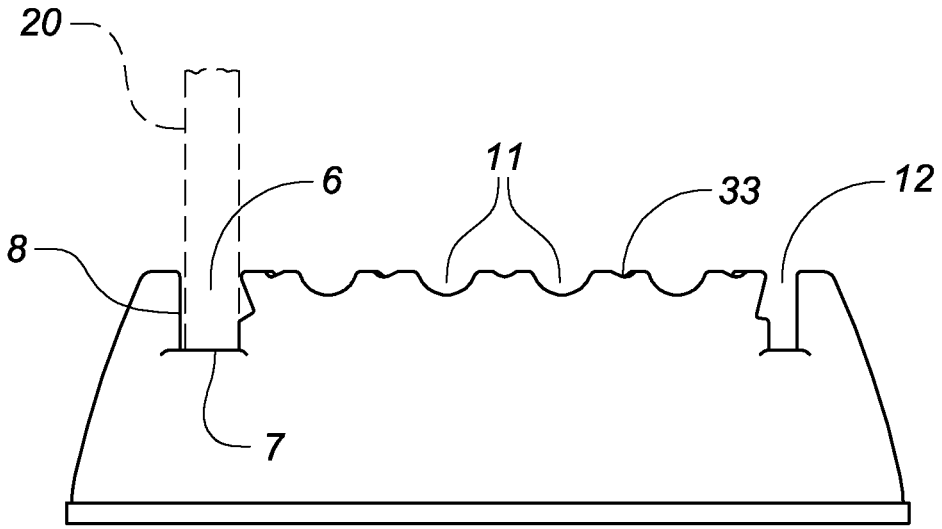
FIG. 2 is a planar, side view of the easel.

The present invention relates a portable easel including a base component 1 having an upper surface 2, a lower surface 3, a continuous periphery 4 and a central aperture 5. In the embodiment depicted in the drawings, the base component is circular, though the shape could be varied. On the upper surface are a plurality of canvas-retaining grooves 6, each having a unique or discrete width and/or depth for receiving an edge of a canvas 20. Each groove is defined by a bottom surface 7 and a pair of opposing sidewalls 8. One of the sidewalls may include an oblique ledge 9 that allows the groove to uprightly support a canvas in at least two different angles. A portion 10 of the sidewall above the ledge extends at a different angle than the opposing sidewall to further support the canvas in either of the two select angles.

One or more arcuate notches 11 are formed on the upper surface of the base component for retaining artist's tools, such as paint brushes, painting and palette knives, scrapers, etc. In one embodiment, the grooves are positioned at opposing portions of the base component while the tool notches are positioned therebetween, so that the tools can be conveniently positioned in front of an upright canvas. Each notch on a given side may align with a corresponding notch on an opposing side so that the paintbrush or other tool can be laid horizontally, if desired. A hole 33 may be positioned between each pair of adjacent notches to uprightly support a paintbrush if desired.

The base component may also include narrow slits 12 randomly positioned on the upper surface to receive and uprightly support canvas boards or similar thinner artist's media. Each slit may have a discrete width so that a single easel can accommodate most standard thicknesses of common canvas boards.

Figure 3:
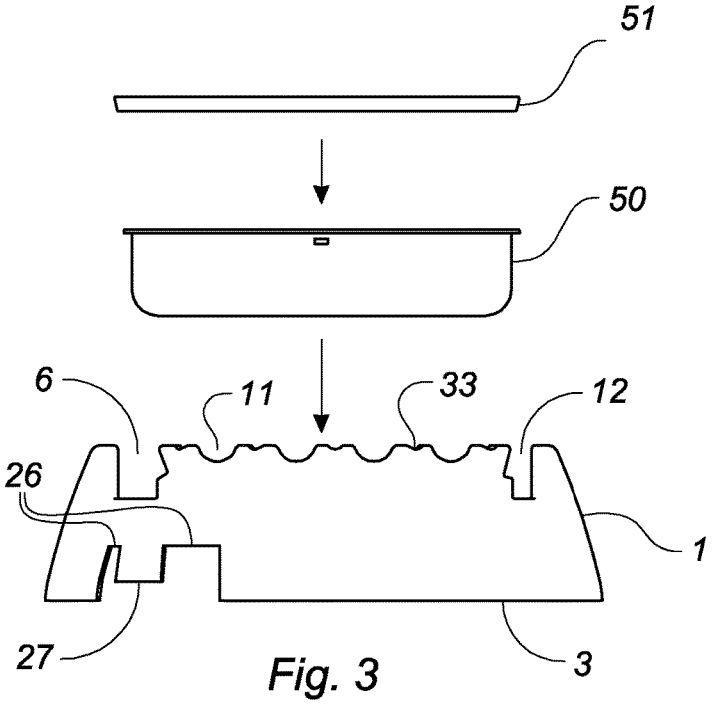
FIG. 3 is a planar, side view of the easel with the optional water bowl suspended above the base component.
Figure 5:
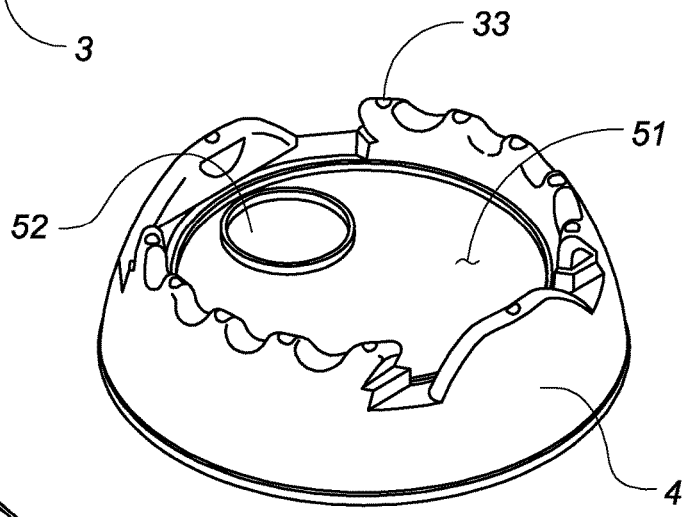
FIG. 5 is an elevated, perspective view of the easel with the water bowl and palette positioned therein.
Figure 4:
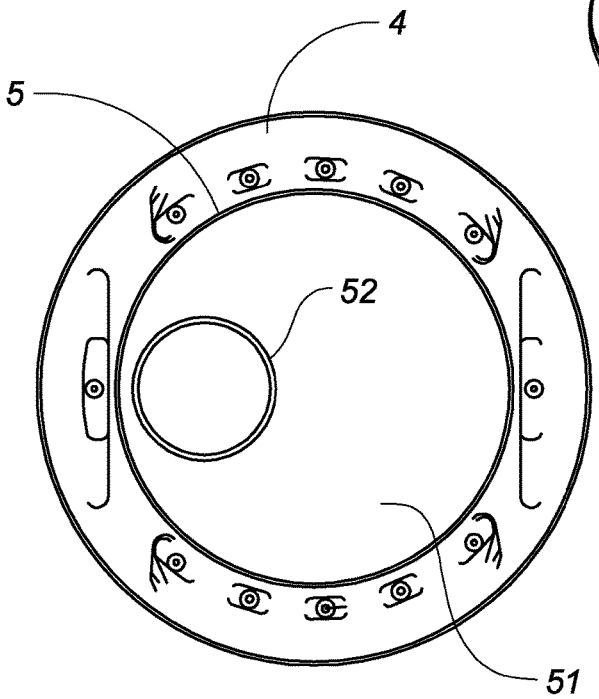
FIG. 4 is a top, plan view of the easel with the water bowl and palette positioned therein.

Now referring to FIG. 3, the lower surface of the base component may include one or more sets 25 of recesses 26 and protrusions 27 that are each dimensioned, spaced and configured to interlock with a designated canvas groove on another easel. Therefore, multiple easels can be seamlessly stacked for storage. The periphery may also include one or more elevated platforms having an inclined surface depending therefrom for supporting an edge of an artist's medium or other item in a different position.

As depicted in FIG. 1, a water bowl 50 may be removably positioned within the central aperture for rinsing brushes and ballasting the base component from sliding or toppling. The bowl is retained by a liner or gasket surrounding the aperture. A painting palette 51 can be positioned atop the bowl or within the central aperture to provide a convenient paint source for the artist. The palette can be easily removed and used in other locations, if desired. The palette may include an opening 52 to allow a paintbrush to access the underlying rinse bowl.

The shape of the base component can also be triangular, rectangular or any other substantially symmetrical shape that minimizes necessary construction materials, while forming a low center of gravity that prevents the device from toppling. Other embodiments of any shape may also omit the central opening to provide more support surface for a canvas or other artist's tools. The base component may include isolated, elevated blocks positioned about a periphery or a central block having sidewalls that further support canvasses in various positions. The elevated blocks may include the canvas grooves while the central block uprightly supports larger canvasses or other items.

The above-described device is not limited to the exact details of construction and enumeration of parts provided herein. For example, the base component shape, and the size, number, relative positioning and configurations of the grooves, notches and recesses can be varied. The bottom surface of the base component may include a turntable mechanism that such as that commonly referred to as a "lazy Susan" that allows an artist to easily reposition a canvas or tools by simply rotating the base component. The base component may also be equipped with a light attachment for illuminating a displayed painting. Finally, a support stand may be used to position the easel for use outdoors. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable easel comprising:

a base component having an upper surface, a lower surface, a continuous periphery and a central aperture;

a plurality of canvas grooves on the upper surface of said base component, each of said canvas grooves having a discrete width and depth;

a canvas received within one of said grooves;

a plurality of arcuate notches formed on the upper surface of the base component;

at least one artist tool received within one of said notches.

2. The portable easel according to claim 1 wherein said canvas grooves are positioned at opposing portions of the base component and said arcuate notches are positioned therebetween, so that the artist's tools can be conveniently positioned in front of an upright canvas.

3. The portable easel according to claim 2 wherein each of said notches align with a corresponding notch on an opposing portion of said base component side so that said artist's tool can be laid horizontally.

4. The portable easel according to claim 1 further comprising a hole positioned between at least one pair of adjacent notches to uprightly support the artist's tool.

5. The portable easel according to claim 1 further comprising narrow slits on the upper surface of the base component for receiving and uprightly supporting thin artist's media.

6. The portable easel according to claim 1 wherein the lower surface of the base component includes at least one recess and one protrusion that are each dimensioned, spaced and configured to interlock with a designated groove on another base component to allow multiple easels to be seamlessly stacked for storage.

7. The portable easel according to claim 1 further comprising a water bowl removably positioned within the central aperture for rinsing brushes and ballasting the base component from sliding or toppling.

8. The portable easel according to claim 7 further comprising a gasket surrounding the central aperture for retaining said water bowl.

9. The portable easel according to claim 8 further comprising a painting palette positioned atop the water bowl or within the central aperture to provide a convenient paint source for the artist.

10. The portable easel according to claim 9 wherein said palette includes an opening for allowing a paintbrush to access said water bowl.

* * * * *